United States Patent [19]

Wegel

[11] 4,328,961

[45] May 11, 1982

[54] HOLD-DOWN FOR USE ON FEED TABLE OF PRINTING PRESS

[75] Inventor: Erich Wegel, Offenbach am Main, Fed. Rep. of Germany

[73] Assignee: M.A.N.-Roland Druckmaschinen Aktiengesellschaft, Fed. Rep. of Germany

[21] Appl. No.: 186,649

[22] Filed: Sep. 12, 1980

[30] Foreign Application Priority Data

Sep. 17, 1979 [DE] Fed. Rep. of Germany ..... 2937541

[51] Int. Cl.[3] ..... B65H 9/00

[52] U.S. Cl. ..... 271/236

[58] Field of Search ..... 271/231, 236, 237, 238, 271/247

[56] References Cited

U.S. PATENT DOCUMENTS 4,049,256 9/1977 Church ..... 271/236

4,260,149 4/1981 Melzer ..... 271/236

*Primary Examiner*—Richard A. Schacher

*Attorney, Agent, or Firm*—Leydig, Voit, Osann, Mayer & Holt Ltd.

[57] ABSTRACT

A sheet feeder for feeding of sheets from a pile to the inlet gripper of a printing press includes a downwardly angled feed table extending between the pile and the press, sheets being fed in succession across the table. A periodically interposed front stop stops the sheet at the end of the table in position for pick-up by the gripper in the press. A side guide at the edge of the table and extending upwardly a short distance therefrom positions the lateral edge of the sheet. A wiping assembly wipes the sheet toward the side guide as it settles against the front stop. To keep the sheet on the table a flexible leaf spring presses downwardly on the sheet in the region of the side guide. A holder engages the upstream end of the spring for holding it at a shallow angle and in a slightly sprung condition. An articulated joint between the holder and the spring permits the downstream end of the leaf spring to swing laterally with the sheet into angled position as the sheet undergoes lateral wiping movement toward the side guide.

4 Claims, 6 Drawing Figures

FIG. 1
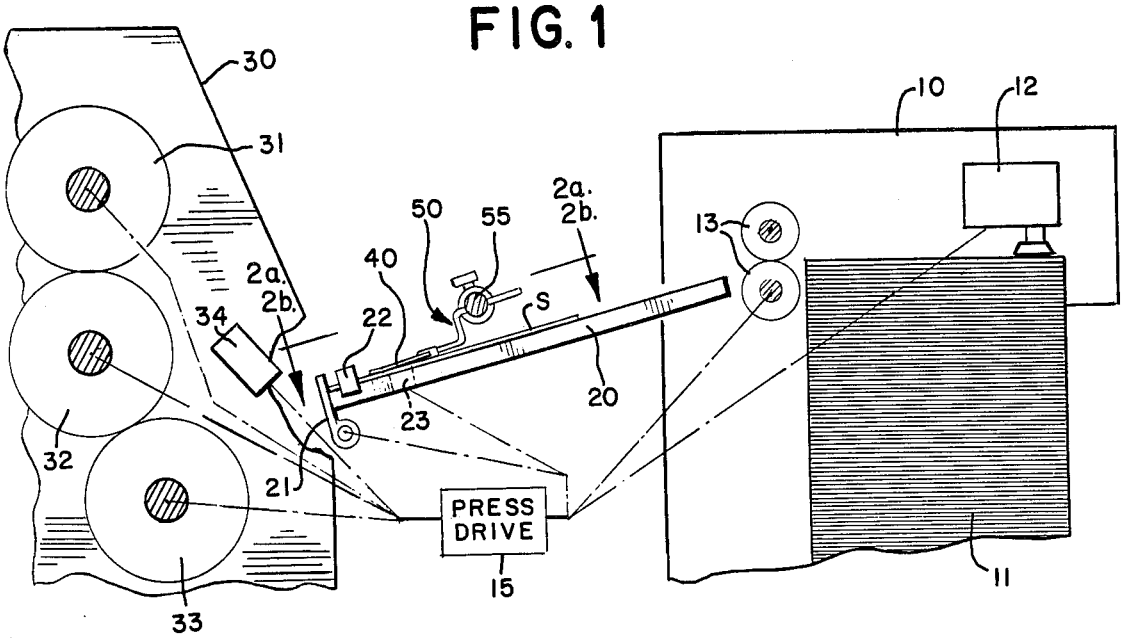
FIG. 2a
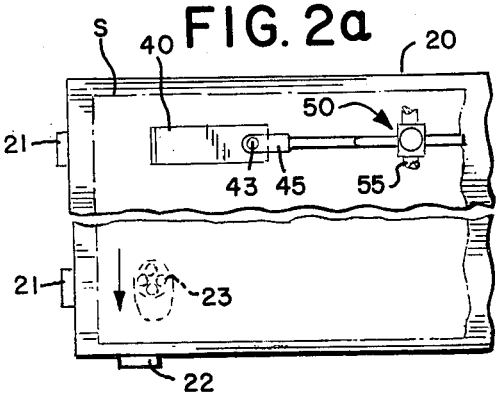
FIG. 2b
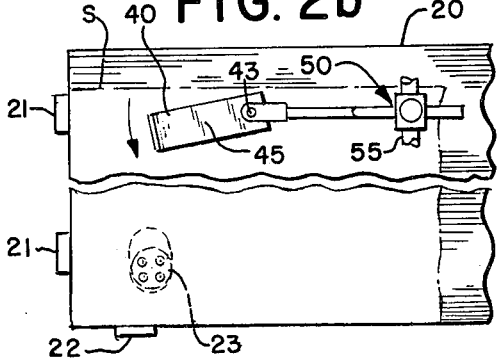
FIG. 3
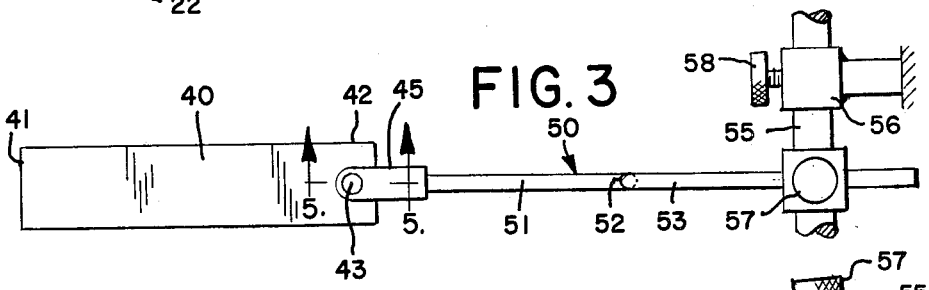
FIG. 4
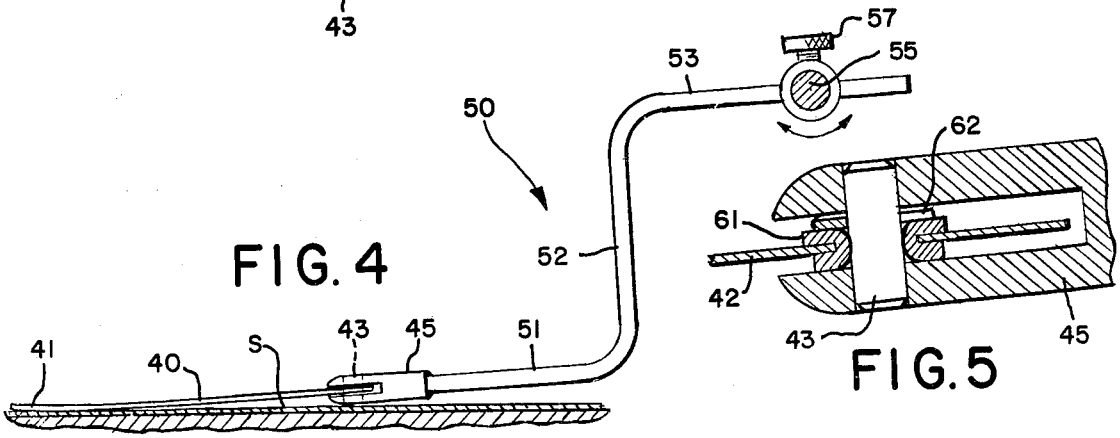
FIG. 5

HOLD-DOWN FOR USE ON FEED TABLE OF PRINTING PRESS

It is standard practice to provide a feed table for feeding sheets successively from a pile to the inlet grippers of a printing press, with each sheet being accurately positioned for pick-up by a front stop and side guide. However, the front stop and side guide can only perform their functions reliably and efficiently if the sheet remains reasonably close to the surface of the table. A sheet tends to remain out of contact with the table because of the air cushion which develops under it and because of the lifting action of the preceding sheet in the series. These effects are particularly troublesome in large presses operating at a high cyclic rate.

Accordingly, various devices have been developed for engaging a sheet and for holding it down to the table. Such devices have included rollers, air jets, spring plates and the like. Spring plates, or leaf springs, have been particularly favored where pressure is to be exerted on the sheet in a position which is not readily accessible. This is generally true along the front edge of the sheet where the packing density of the components is high and where access is obstructed.

However, the use of spring plates does have the disadvantage that where a wiping assembly is provided for wiping the sheet in the direction of the side guide such wiping assembly, in performing its function, must exert a greater force in order to overcome the friction of the spring plate. This creates an undesirable condition.

It is, accordingly, an object of the present invention to provide a leaf spring hold-down which forces the sheet downwardly toward the table at the same time applying a frictional drag to the sheet to decelerate its forward movement without, however, creating a frictional drag on the sheet in the lateral direction, with the result that the sheet may be moved laterally against the side guide with only a light wiping force.

It is a more specific object to provide a leaf spring and holder therefor, the spring being connected to the holder by a pivot connection at the upstream end of the spring so that the spring, while exerting downward pressure, is free to swing laterally following the sheet as it moves in the direction of the side guide.

Thus it is an object to provide a frictional hold-down in which relatively large forces may be developed upon the sheet for holding it down and for decelerating it without impeding the lateral movement of the sheet required to register against the side guide.

It is a general object of the invention to provide a hold-down which is particularly well suited for use on large feed tables operating at its high cyclical rate and which, at the same time, is simple and inexpensive to construct and easy to adjust and maintain.

Other objects and advantages of the invention will become apparent upon reading the attached detailed description and upon reference to the drawings in which:

FIG. 1 is a diagram showing, in elevation, a sheet reservoir and printing press with a downwardly angled feed table in between, the feed table including a hold-down in accordance with the present invention.

FIGS. 2*a* and 2*b* are fragmentary top views of the feed table taken along the correspondingly numbered line in FIG. 1.

FIG. 3 is a top view of the hold-down device shown in the preceding figures including its supporting bracket.

FIG. 4 is a side view of the device of FIG. 3.

FIG. 5 is an enlarged fragmentary section taken along line 5—5 in FIG. 3.

While the invention has been described in connection with a preferred embodiment, it will be understood that I do not intend to be limited by the particular embodiment shown but intend, on the contrary, to cover the various alternative and equivalent constructions included within the spirit and scope of the appended claims.

Turning now to FIG. 1 there is shown a sheet reservoir and feeding mechanism 10 for feeding sheets in succession off the top of a pile 11. The feeding mechanism includes a reciprocating suction device 12 cooperating with a pair of nip rollers 13. Both the nip rollers and suction device are coupled to and driven by the press drive indicated diagrammatically at 15.

Coupled to the outlet of the reservoir is a downwardly sloping feed table 20 having a front stop 21 for positioning a sheet, indicated at S, at the front edge of the table and a side guide 22 for positioning the lateral edge. In order to wipe the sheet in the lateral direction, in the direction of the side guide, a wiping device 23 is provided which may be in the form of a vacuum head mounted for lateral reciprocating movement and recessed in the surface of the table 20. To insure that the wiping action and subsequent release of the front edge of the sheet are coordinated with one another, and with the arrival of the sheet, both the front stop 21 and wiping device 23 are, as diagrammatically shown, coupled to the press drive 15. For further details of a typical wiping device reference is made to application Ser. No. 066,532 filed Aug. 15, 1979 now U.S. Pat. No. 4,260,149.

The sheet S is, from the lower end of the table, fed into a press 30 having a plate cylinder 31, blanket cylinder 32 and impression cylinder 33, all of which are conventionally driven. For the purpose of snatching the sheet from the table, so that it may be passed between the blanket and impression cylinders, a conventional gripper mechanism 34 also coupled to the press drive, is provided in the press adjacent the feed table. While the gripper mechanism, for the sake of simplicity, has not been illustrated it will be understood that it is per se conventional, cross reference being made to application Ser. No. 064,082 filed Aug. 6, 1979, owned by the same assignee.

In accordance with the present invention the feed table 20 is provided with a hold-down device for the sheet in the form of a resilient leaf spring 40 formed of light gauge metal extending along the normal path of travel of the sheet, with a holder engaging the upstream end of the spring for holding the spring at a shallow angle with respect to the feed table so that the sheet is flatly engaged by the downstream end in a slightly sprung condition. An articulated joint between the holder and the leaf spring permits the downstream end of the leaf spring to swing laterally with the sheet into angled position as the sheet undergoes lateral wiping movement toward the side guide.

Thus referring to FIGS. 3–5 for the details of the construction, a leaf spring, indicated at 40, is flat and rectangularly shaped having a downstream end 41 which engages the sheet and an upstream end 42 having an articulated joint in the form of a vertical pivot connection 43 with respect to a clevise 45 which forms the end of a holder 50. The holder is made of a bent rod having a generally horizontal lower portion 51, a generally vertical portion 52, and a generally horizontal upper portion 53 to form a "Z".

For the purpose of angularly adjusting the holder to adjust the shallow angle of the leaf spring the holder is socketed in a bracket 55 which has provision for angular adjustment about a horizontal axis which is at right angles to the direction of feeding movement of the sheet. Thus the bracket 55 is preferably mounted in a collar 56. The degree of extension of the holder from the bracket is controlled by a thumb screw 57, while the downward angling is controlled by adjustment of a thumb screw 58 in the collar.

The articulated joint 43 between the leaf spring 40 and the holder 50 is preferably such as to enable freedom of lateral swinging movement while restricting the degree of vertical play, so that the angling of the holder is directly and positively reflected in the angular position occupied by the blade and the degree of springing which it exerts. Thus to provide a bearing for lateral swinging movement about the pivot 43, the upstream end of the blade has an opening into which is fitted a grommet or eyelet 61 which is preferably formed of brass or other anti-friction metal. The remaining axial space within the clevise 45 is substantially occupied by a spring washer 62.

Because of the downward springing of the leaf spring against the sheet S, accompanied by slight bowing of the spring, the sheet is crowded downwardly toward the table which tends to squeeze out the air which has been entrapped under the sheet as well as to decelerate the sheet as it approaches the front stop 21. This improves control of the sheet by insuring that the leading edge portion of the sheet is at a level which is lower than the tops of the front stop and side guide so that the sheet is certain to be engaged and shifted to its reference position on the feed table ready for removal by the gripper 34.

It is a primary feature of the present invention, however, that the downward friction-producing force which is applied to the sheet is effective only in the direction of motion and not at right angles to the direction of motion, with the result that the wiping device 23, which wipes the sheet toward the side guide, need only overcome the friction of the sheet and not the friction of the leaf spring which engages it.

This will be made clear by reference to FIGS. 2*a* and 2*b* which are stop motion views taken as the sheet approaches the front stop 21 at the lower edge of the table. In FIG. 2*a* the sheet is approaching the front stop 21 but separated from the side guide 22, with the wiping device 23 poised at the beginning of its lateral stroke. The leaf spring 40 of the hold-down device is self-aligned with the direction of feeding movement of the sheet.

Referring next to FIG. 2*b*, as the front edge of the sheet moves toward engagement with the front stop 21, vacuum is applied to the wiping device 23 so that it wipes the sheet laterally toward, and into engagement with the side guide 22. Such lateral movement is accommodated by horizontal articulation of the leaf spring 40 about the pivot 43 so that the wiping device 23 need not overcome the frictional engagement between the spring and the sheet. The wiping device 23 is therefore not overloaded by, or in any way affected by, the presence of the leaf spring, regardless of the level of force to which the spring has been adjusted and regardless of whether the spring is provided singly or in multiple across the width of the sheet.

When the front stops are released and the grippers pull the sheet from the table, the straight line feeding movement of the sheet again restores the leaf spring to its straight, longitudinally extending position illustrated in FIG. 2*a*.

What I claim is:

1. A sheet feeder for feeding of sheets from a pile to the inlet gripper of a printing press comprising in combination, a downwardly angled feed table, a feeding device for feeding sheets from the pile in succession along the table, means including a periodically interposed front stop for stopping a sheet at the end of the table in position for pick-up by the gripper in the press, a side guide at the edge of the table and extending upwardly a short distance therefrom for engaging the lateral edge of the sheet, a lateral wiping assembly for wiping the sheet toward the side guide as it settles against the front stop, a leaf spring for pressing the sheet toward the table in the region of the side guide, the spring having an upstream end and a downstream end, a holder engaging the upstream end for holding the spring at a shallow angle so that the sheet is flatly engaged by the downstream end in a slightly sprung condition, and an articulated joint between the holder and the leaf spring permitting the downstream end of the leaf spring to swing laterally with the sheet into angled position as the sheet undergoes lateral wiping movement toward the side guide.

2. The combination as claimed in claim 1 including a bracket for supporting the holder, the bracket being angularly adjustable for adjustment of the shallow angle and hence the amount of force exerted by the spring against the sheet.

3. The combination as claimed in claim 1 in which the holder is in the form of a rod bent into "Z" shape having a generally horizontal lower portion providing a vertical pivot connection with the leaf spring, a generally vertical portion, and a generally horizontal upper portion, and a bracket for engaging the upper portion of the rod, the bracket including provision for angular adjustment about a horizontal axis which is at right angles to the direction of feeding movement of the sheet.

4. The combination as claimed in claim 1 in which the articulated joint between the holder and the leaf spring includes a pin in the holder telescoped through an opening in the leaf spring, the opening having an anti-friction fitted collar in the form of a grommet engaging both sides of the spring, and means for limiting the endwise play of the collar on the pin so that changes in the angling of the holder are reflected directly in the amount of force applied to the sheet by the spring.

* * * * *